US008193692B2

(12) United States Patent
Lee et al.

(10) Patent No.: US 8,193,692 B2
(45) Date of Patent: Jun. 5, 2012

(54) SURFACE FIELD ELECTRON EMITTERS USING CARBON NANOTUBE YARN AND METHOD OF FABRICATING CARBON NANOTUBE YARN THEREOF

(75) Inventors: Cheol-Jin Lee, Seoul (KR); Seung-Il Jung, Seoul (KR); Guohai Chen, Seoul (KR)

(73) Assignee: Korea University Industrial & Academic Collaboration Foundation, Seoul (KR)

( * ) Notice: Subject to any disclaimer, the term of this patent is extended or adjusted under 35 U.S.C. 154(b) by 426 days.

(21) Appl. No.: 12/389,280

(22) Filed: Feb. 19, 2009

(65) Prior Publication Data

US 2010/0181896 A1 Jul. 22, 2010

(30) Foreign Application Priority Data

Jan. 16, 2009 (KR) ..... 10-2009-0003934

(51) Int. Cl.
*H01J 1/62* (2006.01)
*H01J 9/00* (2006.01)

(52) U.S. Cl. ..... 313/495; 313/336; 313/351; 445/23

(58) Field of Classification Search ..... 313/309, 313/336, 351, 495–497; 445/23–25
See application file for complete search history.

(56) References Cited

U.S. PATENT DOCUMENTS

| | | | | |
|---|---|---|---|---|
| 5,973,444 | A * | 10/1999 | Xu et al. | 313/309 |
| 6,281,626 | B1 * | 8/2001 | Nakamura et al. | 313/491 |
| 2002/0031972 | A1 | 3/2002 | Kitamura et al. | |
| 2004/0047038 | A1 * | 3/2004 | Jiang et al. | 359/486 |

FOREIGN PATENT DOCUMENTS

KR 10-0491703 B1 5/2005

* cited by examiner

*Primary Examiner* — Joseph L Williams
(74) *Attorney, Agent, or Firm* — Lowe Hauptman Ham & Berner LLP

(57) ABSTRACT

Surface field electron emitters using a carbon nanotube yarn and a method of fabricating the same are disclosed. To fabricate the carbon nanotube yarn for use in fabrication of simple and efficient carbon nanotube field electron emitters, the method performs densification of the carbon nanotube yarn during rotation of a plying unit and heat treatment of the carbon nanotube yarn that has passed through the plying unit without using organic or inorganic binders or polymer pastes. The method fabricates the carbon nanotube yarn with excellent homogeneity and reproducibility through a simple process. The carbon nanotube yarn-based surface field electron emitters can be applied to various light emitting devices.

23 Claims, 10 Drawing Sheets

SURFACE FIELD ELECTRON EMITTERS USING CARBON NANOTUBE YARN AND METHOD OF FABRICATING CARBON NANOTUBE YARN THEREOF

BACKGROUND OF THE INVENTION

1. Field of the Invention

The present invention relates to carbon nanotube (CNT) yarn-based surface field electron emitters and a method of fabricating the carbon nanotube yarn thereof. More particularly, the present invention relates to a method of fabricating surface field electron emitters based on electron emission from the surface of a carbon nanotube yarn upon application of an electric field to the carbon nanotube yarn, which is formed in an elongated wire shape having a diameter of several dozen to several hundred of micrometers by longitudinally aligning carbon nanotubes each having a diameter of several to several dozen nanometers.

2. Description of the Related Art

For electron emitters with a fine structure, carbon nanotubes or carbon nanowires are preferred as materials for electron emission. "Carbon nanotube" generally refers to a fine structure grown in a tube shape, and has a variety of kinds well known in the related art. The carbon nanotube exhibits excellent electrical, mechanical, chemical, and thermal properties, which allow the carbon nanotube to be applied in various fields.

The carbon nanotube has a low work function, a high aspect ratio, and a very large field emission factor due to a low radius of curvature at the top or emission end thereof so that the carbon nanotube can emit electrons even in an electric field of low potential.

As a conventional method of fabricating carbon nanotube field electron emitters, there are a method of forming a carbon nanotube directly on a conductor such as a cathode or substrate through vertical growth, and a method of attaching carbon nanotube powder to a cathode after synthesizing the carbon nanotube powder through a separate process.

Then, the carbon nanotube field electron emitters generally exhibit a phenomenon of emitting electrons from the tip end of the carbon nanotube upon application of an electric field thereto. In this regard, body emission of the carbon nanotube has been reported in recent years, that is, electrons are emitted from the surface of the carbon nanotube instead of the tip end of the carbon nanotube.

Furthermore, recent reports say that horizontally aligned carbon nanotube field electron emitters exhibit more stable and uniform field electron emission than vertically aligned carbon nanotubes.

However, it is very difficult to fabricate the horizontally aligned carbon nanotube field electron emitters, and, even if fabricated, fabrication efficiency is not satisfactory.

In a conventional method of fabricating a carbon nanotube yarn, a thin carbon nanotube strand is drawn out from a carbon nanotube, which is vertically grown on a silicon wafer, by Van der Waals' force exerted between edges of the carbon nanotubes when pulling the carbon nanotube from the edge of the carbon nanotube. Then, several carbon nanotube strands are plied, thereby providing the carbon nanotube yarn.

When an electric field is vertically applied to the diameter of the prepared carbon nanotube yarn, electrons are emitted from the overall surface of the carbon nanotube yarn, that is, from the body (or lateral surface) of the carbon nanotube yarn, as is opposed to the general carbon nanotube that emits electrons only from the tip end (edge) thereof.

However, the tip ends of the carbon nanotube strands protrude from the surface of the carbon nanotube yarn, thereby reducing field electron emission efficiency.

As such, since the ends of the carbon nanotubes protruding from the surface of the carbon nanotube yarn cause a reduction in field electron emission efficiency, it is necessary to form a smooth surface of the carbon nanotube yarn. Thus, for fabrication of the carbon nanotube yarn, conductive organic or inorganic binders, or polymer pastes are added to flatten the surface of the yarn. However, since this process is complicated and causes a cost increase, it is not generally applied in practice.

SUMMARY OF THE INVENTION

The present invention is conceived to solve the problems as described above, and an aspect of the present invention is to provide a method of fabricating a carbon nanotube yarn for use in fabrication of simple and efficient carbon nanotube field electron emitters through densification during rotation of a plying unit and heat treatment of the carbon nanotube yarn that has passed through the plying unit. In this method, an organic solvent selected from methanol, ethanol, acetone, dichloroethane, chloroform, ethylene glycol, dichlorobenzene, and dimethylformamide is used for plying thin carbon nanotube strands instead of organic or inorganic binders or polymer pastes. The method fabricates the carbon nanotube yarn with excellent homogeneity and reproducibility through a simple process.

Another aspect of the present invention is to provide field electron emitters fabricated using the carbon nanotube yarn, which have reliability, stability and economic feasibility and can be applied to various field electron emitting devices and light emitting sources.

In accordance with an aspect of the present invention, a surface field electron emitter using a carbon nanotube yarn includes a plurality of carbon nanotube strands aligned in the same direction and plied with each other, wherein the plied carbon nanotube strands constitute a carbon nanotube yarn having a smooth surface from which tip ends of the carbon nanotube strands are not protruded.

The carbon nanotube strands may include at least one selected from a multi-walled carbon nanotube (MWCNT), a single-walled carbon nanotube (SWCNT) and a double-walled carbon nanotube (DWCNT). The carbon nanotube strands may be plied with each other in a state of being aligned parallel to each other in the same direction, or plied with each other in a twisted shape. The carbon nanotube yarn may have a thickness of 1~1000 μm.

In accordance with another aspect of the present invention, a method of fabricating a carbon nanotube yarn includes preparing a plurality of carbon nanotube strands; forming a carbon nanotube yarn by passing the carbon nanotube strands through a plying unit with the carbon nanotube strands aligned in the same direction; and heat treating the carbon nanotube yarn, wherein the forming a carbon nanotube yarn comprises surface treatment for densification by immersing the carbon nanotube strands in an organic solvent when the carbon nanotube strands enter the plying unit filled with the organic solvent, and applying tension to the carbon nanotube yarn discharged from the plying unit to provide a smooth surface to the carbon nanotube yarn while increasing a bonding force between the carbon nanotube strands and preventing tip ends of the carbon nanotube strands from protruding from the surface of the carbon nanotube yarn.

The plying unit may be rotatable, and the plurality of carbon nanotube strands may be plied with each other in a state of being aligned parallel to each other in the same direction or may be plied with each other in a twisted shape by controlling a rotational speed of the plying unit. The rotational speed of the plying unit may be controlled in the range of 10~300 rpm. The carbon nanotube strands may pass through the plying unit within 2 seconds to 9 minutes. The organic solvent may be at least one selected from methanol, ethanol, acetone, dichloroethane, chloroform, ethylene glycol, dichlorobenzene, and dimethylformamide. The tension applied to the carbon nanotube yarn may be controlled in the range of 0.0005~0.5 mN. The heat treating may be performed for 1~30 minutes at 100~1,500° C. The method may further include irradiating an electron beam or a laser beam onto the surface of the carbon nanotube yarn to provide a smoothly finished surface to the carbon nanotube yarn after the heat treating. The carbon nanotube yarn may have a plied density of $10^2$~$10^5$ carbon nanotube strands per unit cross-sectional area ($\mu m^2$) with respect to a thickness of the carbon nanotube yarn.

In accordance with a further another aspect of the present invention, a field electron emitting device using the carbon nanotube yarn according to the aspect of the present invention includes a substrate formed of one selected from metal, glass, paper and a flexible plastic material. The substrate may have a planar shape of a polygon or looped curve and have the carbon nanotube yarn wound at uniform intervals around the substrate. The substrate may have a three-dimensional shape and have the carbon nanotube yarn wound at uniform intervals around the substrate. The carbon nanotube yarn may be wound around the substrate in two or more layers. The substrate may be a cylindrical tube through which the carbon nanotube yarn passes. The carbon nanotube yarn may be formed into woven fabrics to be wound around the substrate or arranged on the substrate.

In accordance with yet another aspect of the present invention, a diode type field electron emitting device includes front and rear glass substrates bonded to each other with a separation space defined therebetween; insulating spacers arranged in the separation space to form a line type light emitting region in the separation space; a cathode provided to a region between the insulating spacers on the rear glass substrate; the carbon nanotube yarn according to the aspect of the present invention disposed on the cathode; an anode provided to a region between the insulating spacers on the front glass substrate; and a phosphor layer formed on the anode.

In accordance with yet another aspect of the present invention, a triode type field electron emitting device includes a rear glass substrate including line type insulating spacers; a cathode provided to a region between the insulating spacers on the rear glass substrate; the carbon nanotube yarn according to the aspect of the present invention disposed on the cathode; a grid formed above the spacers to be spaced from the carbon nanotube yarn and formed in a line pattern orthogonal to the line type insulating spacers; an anode bonded onto the grid to cross the grid; and a front glass substrate including a phosphor formed on the anode.

In accordance with yet another aspect of the present invention, an apparatus for fabricating a carbon nanotube yarn includes a plying unit disposed to rotate around a path through which a plurality of carbon nanotube strands move, wherein the plying unit integrally includes an entrance part collecting and aligning the plurality of carbon nanotube strands in the same direction; an immersing part allowing the plurality of carbon nanotube strands aligned in the same direction to pass through the entrance unit while immersing the carbon nanotube strands in an organic solvent to ply the carbon nanotube strands with each other; and a discharge part discharging the plied carbon nanotube strands in a catching and drawing manner to form a carbon nanotube yarn.

The plying unit may have a conical shape with a width gradually decreasing from the entrance part to the discharge part. The plying unit may further include a spiral groove formed on an inner surface thereof to guide the carbon nanotube strands to be plied with each other in a twisted shape.

BRIEF DESCRIPTION OF THE DRAWINGS

The above and other aspects, features and advantages of the present invention will become apparent from the following description of exemplary embodiments given in conjunction with the accompanying drawings, in which.

DETAILED DESCRIPTION OF THE EMBODIMENT

Figure 1:
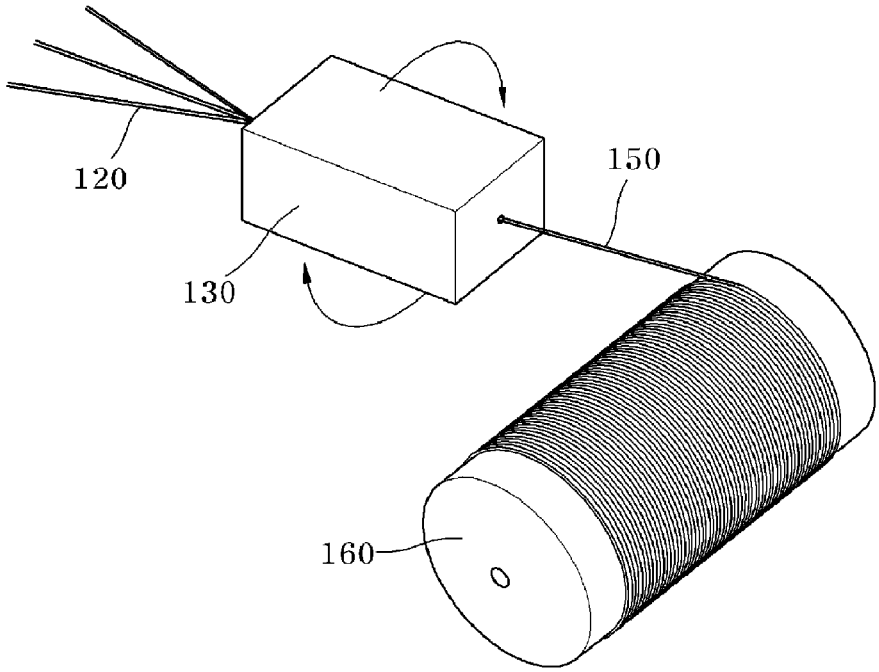
FIG. 1 is a schematic view illustrating a method of fabricating a carbon nanotube yarn according to an embodiment of the present invention.
Figure 2:
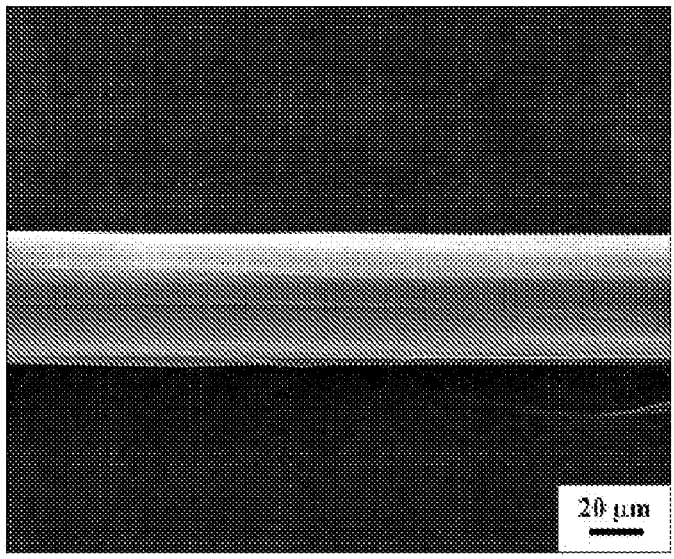
FIGS. 2 to 5 are SEM micrographs of the surface of a carbon nanotube yarn according to an embodiment of the present invention.
Figure 3:
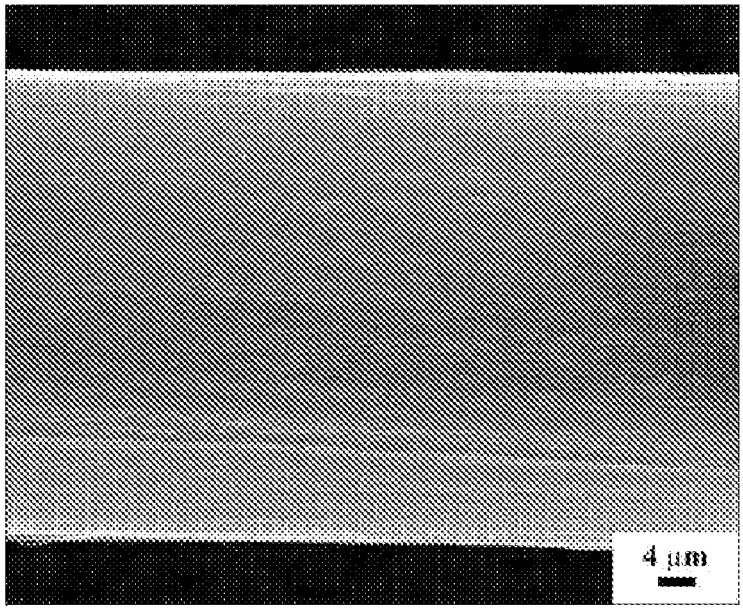
Figure 4:
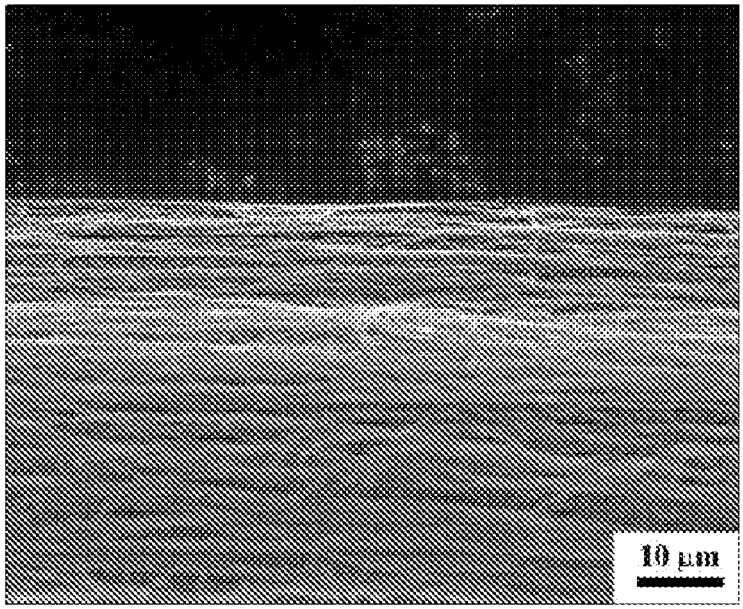
Figure 5:
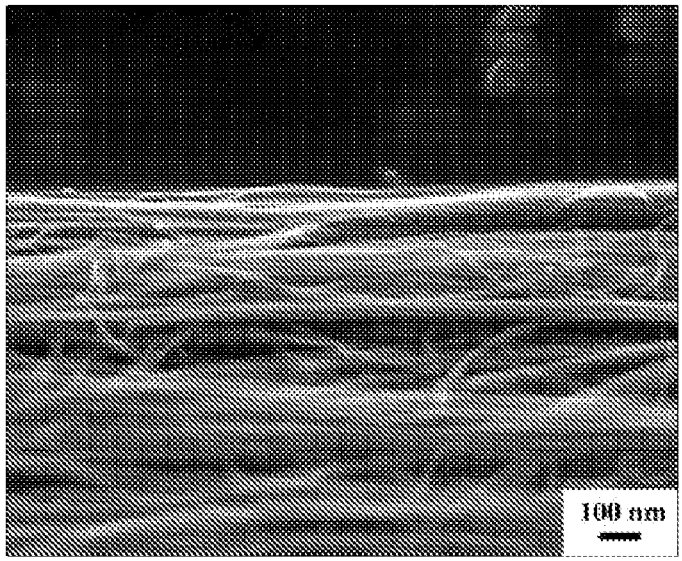

Exemplary embodiments of the present invention will be described in detail with reference to the accompanying drawings.

However, it should be noted that the present invention is not limited to the following embodiments and can be realized in various forms, and that the embodiments are given by way of illustration for fully explain of the present invention by those skilled in the art. The present invention is defined only by the accompanying claims. Like reference numerals will denote like elements throughout the specification Referring to FIG. 1, which schematically illustrates a method of fabricating a carbon nanotube yarn according to an embodiment of the present invention, plural strands of thin carbon nanotube 120 pass through a plying unit 130 to form a carbon nanotube yarn 150 which will be used for fabrication of field electron emitters. The carbon nanotube may be at least one selected from a multi-walled carbon nanotube (MWCNT), a single-walled carbon nanotube (SWCNT) and a double-walled carbon nanotube (DWCNT).

The plying unit 130 has a tube shape and is formed at opposite ends with an opening through which the carbon nanotube strand can pass. The plying unit 130 contains an organic solvent that imparts viscosity to ply the carbon nanotube strands 120 with each other. The organic solvent may be at least one selected from methanol, ethanol, acetone, dichloroethane, chloroform, ethylene glycol, dichlorobenzene, and dimethylformamide.

The carbon nanotube strands 120 may pass through the plying unit 130 within 2 seconds to 9 minutes so as to prevent the carbon nanotube strands from being immersed in the organic solvent for an excessively long duration. Immersion of the carbon nanotube strands 120 for less than 2 seconds can result in the provision of an undesired viscosity to the carbon nanotube strands, whereas immersion of the carbon nanotube strands 120 for more than 9 minutes can result in abnormal operation when removing the organic solvent from the carbon nanotube yarn.

The plying unit 130 is rotated for densification of the carbon nanotube yarn. As the plying unit 130 is rotated, the thin carbon nanotube strands 120 aligned in the same direction are more firmly plied with each other while rotating along with the organic solvent inside the plying unit 130. Further, the size of a nozzle in a discharge part or the rotational speed of the plying unit 130 may be controlled to adjust a twisted degree of carbon nanotube yarn. This operation is based on the same principle as that when a wet towel is twisted, the twisted shape of the towel is maintained. To realize this principle, the rotational speed of the plying unit 130 may be controlled in the range of 10~300 rpm.

In FIG. 1, the plying unit 130 is shown as having a box shape, but may have a conical shape with a width gradually decreasing in a direction of discharging the carbon nanotube yarn 150. Further, the plying unit 130 may have a spiral groove formed on an inner surface thereof to guide the carbon nanotube strands 120 to be more firmly plied with each other. The spiral groove may be formed near the discharge part of the playing unit 130 through which the carbon nanotube yarn 150 is discharged. However, the present invention is not limited thereto.

The plying unit can be modified in various shapes without being limited to the aforementioned structure. For example, the plying unit 130 may have a box-shaped appearance with a conical inner configuration as described above.

The discharge part of the plying unit 130 may be provided with a densification nozzle (not shown) that can provide a smoothly finished surface to the carbon nanotube yarn 150. Here, the speed of the carbon nanotube yarn 150 passing through the densification nozzle may be controlled by a roll winding the discharged carbon nanotube yarn 150, and determines tension exerted on the carbon nanotube yarn 150. Here, surface finishing of the carbon nanotube yarn 150 can be varied according to the tension. The tension applied to the carbon nanotube yarn may be in the range of 0.0005~0.5 mN. A tension less than 0.0005 mN can cause insufficient densification of the carbon nanotube yarn, and a tension exceeding 0.5 mN can cause damage of the carbon nanotube yarn.

Then, heat treatment is performed to maintain a more firmly plied state of the carbon nanotube yarn 150 while evaporating the organic solvent from the carbon nanotube yarn 150. The heat treatment may be performed at 100~1,500° C. for 1~30 minutes.

After the heat treatment, an electron beam or a laser beam is irradiated onto the surface of the carbon nanotube yarn 15 to provide a smoothly finished surface to the carbon nanotube yarn 150.

According to the present invention, the resultant carbon nanotube yarn may have a thickness of 1~1000 μm and a plied density of $10^2$~$10^5$ carbon nanotube strands per unit cross-sectional area ($\mu m^2$) with respect to the thickness of the carbon nanotube yarn. Such a plied density of the carbon nanotube strands 120 is a high density state that cannot be obtained by the conventional technique, and surface finishing for obtaining such a plied density cannot be easily achieved by the conventional technique, either. In this way, the method of the present invention provides the carbon nanotube yarn with a smooth surface, as can be seen from the following SEM micrographs.

FIGS. 2 to 5 are SEM micrographs of the surface of a carbon nanotube yarn according to an embodiment of the present invention.

The micrographs were taken at different magnifications which were gradually increased from FIG. 2 to FIG. 5. As can be seen from FIGS. 2 to 5, the carbon nanotube yarn is finished to have a smooth surface, and has no crack on the surface thereof, which indicates that the densification of the carbon nanotube was stably performed.

When using the carbon nanotube yarn according to this invention, surface field electron emitters may have improved stability and reliability in field electron emission, and may be fabricated with superior reproducibility to have a uniform surface by a simple process at room temperature even without using impurities such as conductive organic materials and pastes.

Since the carbon nanotube yarn has a smooth surface and is highly densified, electrons can be uniformly emitted from the surface thereof. Accordingly, the carbon nanotube yarn may be applied to cylindrical light sources such as fluorescent lamps, and may be wound around a variety of frames (planar substrate or flexible substrate) to be used as various electron emitters.

Figure 6:
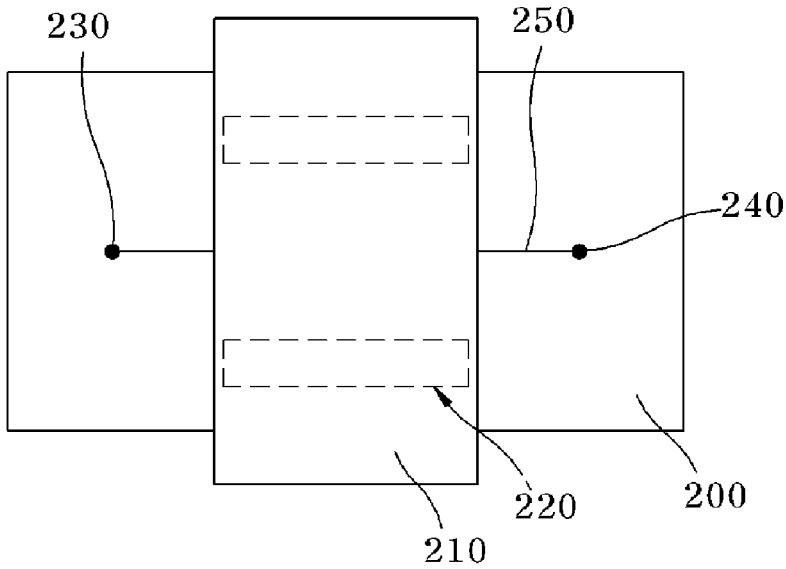
FIGS. 6 and 7 are a top view and a picture of a field electron emitter fabricated using a carbon nanotube yarn according to an embodiment of the present invention.
Figure 7:
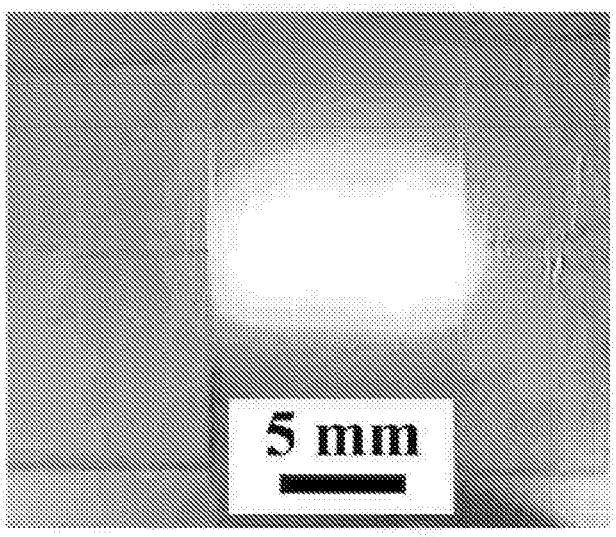

FIGS. 6 and 7 are a top view and a picture of a field electron emitter fabricated using a carbon nanotube yarn according to an embodiment of the present invention Referring to FIG. 6, a carbon nanotube yarn 250 according to an embodiment of the invention is disposed on a substrate 200 with opposite ends of the carbon nanotube yarn 250 secured by silver pastes 230 and 240.

Then, a transparent electrode substrate (ITO) 210 is coated with phosphors and is then disposed above the carbon nanotube yarn 250. Spacers 220 are provided between the transparent electrode substrate 210 and the substrate 200 to prevent the carbon nanotube yarn 250 from being compressed.

Then, a cathode is connected to the carbon nanotube yarn 250 and an anode is connected to the transparent electrode substrate 210, so that electrons can be emitted from the surface of the carbon nanotube yarn 250 by application of an electric field to the carbon nanotube yarn 250, and stimulate the phosphors on the transparent electrode substrate 210 to emit light.

Referring to FIG. 7, which shows a test result with respect to the carbon nanotube yarn 250, it can be seen that electrons are uniformly emitted from the overall surface of the carbon nanotube yarn 250 so that light is uniformly emitted from the overall phosphors.

Figure 8:
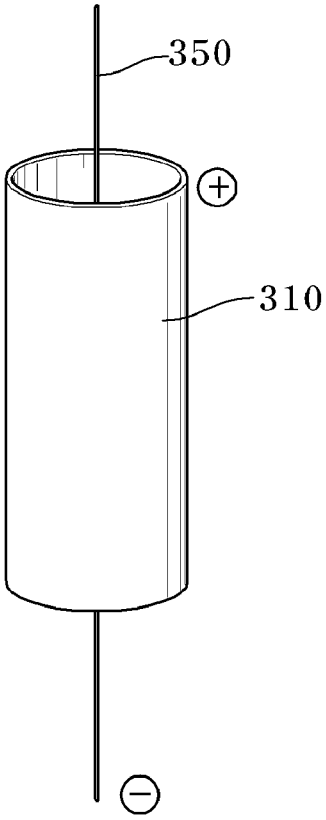
FIG. 8 is a schematic view of a cylindrical light emitting tube based on surface field electron emitters fabricated using a carbon nanotube yarn according to an embodiment of the present invention.

FIG. 8 is a schematic view of a cylindrical light emitting tube based on surface field electron emitters fabricated using a carbon nanotube yarn according to an embodiment of the present invention.

Referring to FIG. 8, a transparent electrode substrate 310 is coated with phosphors and is formed into a cylindrical tube. Then, a carbon nanotube yarn 350 according to an embodiment of the invention is placed within the tube-shaped transparent electrode substrate 310, thereby providing a field electron emitting device such as fluorescent lamps.

Figure 9:
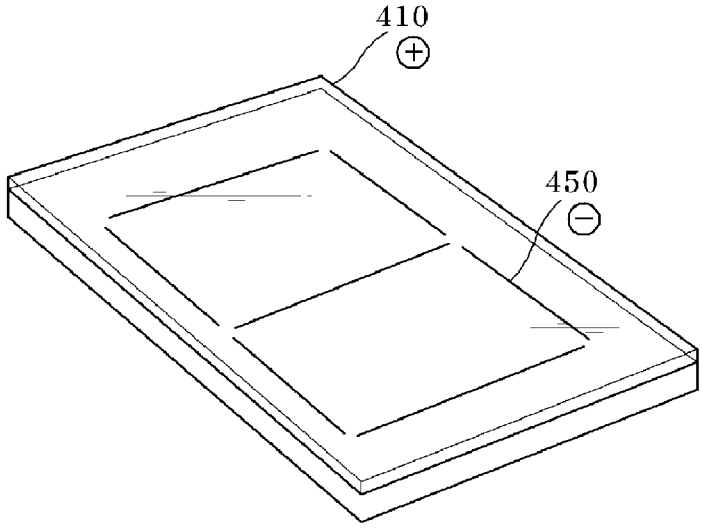
FIG. 9 is a schematic view of a figure display board based on surface field electron emitters fabricated using a carbon nanotube yarn according to an embodiment of the present invention.

FIG. 9 is a schematic view of a figure display board including a surface field electron emitter fabricated using a carbon nanotube yarn according to an embodiment of the present invention.

Referring to FIG. 9, a transparent electrode substrate 410 is coated with phosphors, and is provided with a carbon nanotube yarn 450 according to an embodiment of the present invention in a figure or character shape on a lower surface thereof. The transparent electrode substrate 410 can be applied to field electron emitting devices such as signboards, traffic boards, signal lamps, and the like.

Figure 10:
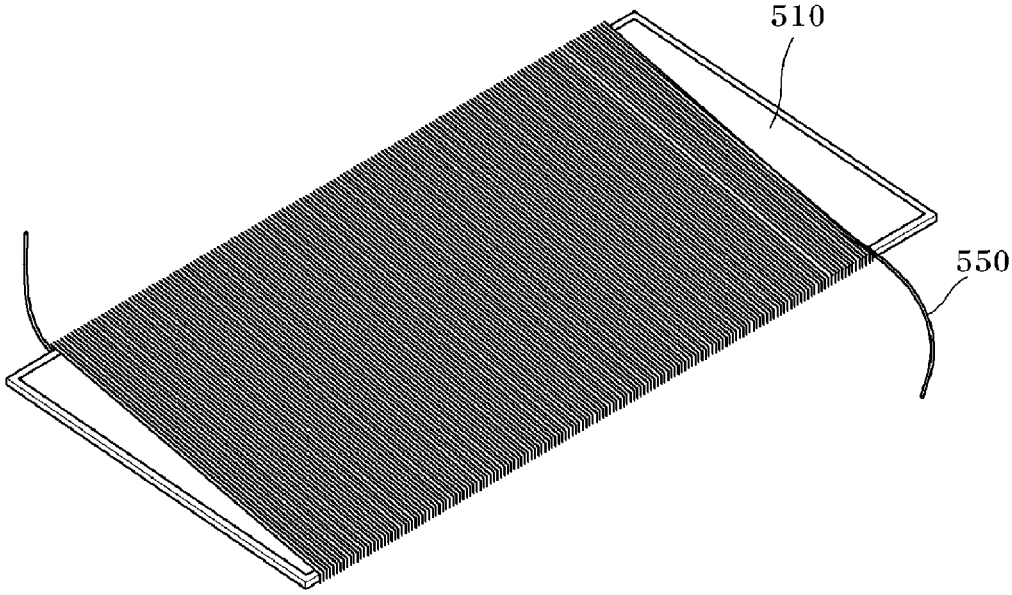
FIG. 10 is a schematic view of a planar substrate based on surface field electron emitters fabricated using a carbon nanotube yarn according to an embodiment of the present invention.

FIG. 10 is a schematic view of a planar substrate based on surface field electron emitters fabricated using a carbon nanotube yarn according to an embodiment of the present invention.

Referring to FIG. 10, a carbon nanotube yarn 550 according to an embodiment of the present invention is uniformly wound around a prepared planar substrate 510, which may be applied to field electron emitting devices such as backlight units for flat displays.

The brightness of the backlight unit can be adjusted by controlling a winding separation or density of the carbon nanotube yarn 550.

Figure 11:
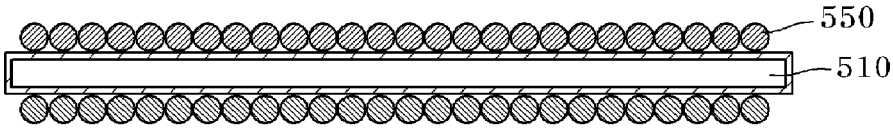
FIGS. 11 and 12 are cross-sectional views of the planar substrate based on the surface field electron emitter fabricated using the carbon nanotube yarn according to the embodiment of the present invention.
Figure 12:
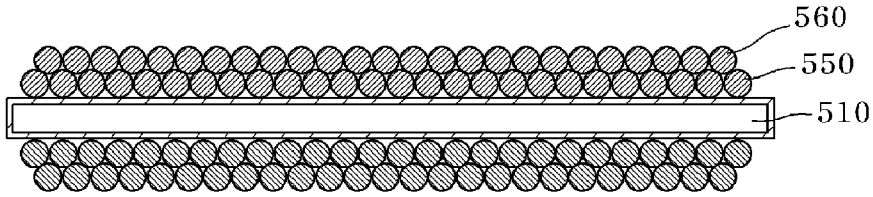

FIGS. 11 and 12 are cross-sectional views of the planar substrate based on the surface field electron emitters fabricated using the carbon nanotube yarn according to the embodiment of the present invention.

FIG. 11 shows the carbon nanotube yarn 550 wound in a single layer around the planar substrate 510, and FIG. 12 shows first and second carbon nanotube yarn layers 550 and 560 wound in double layers around the planar substrate 510. When the carbon nanotube yarn is wound in double layers, the density and bonding force of the field electron emitters with respect to the substrate 510 can be further increased.

Figure 13:
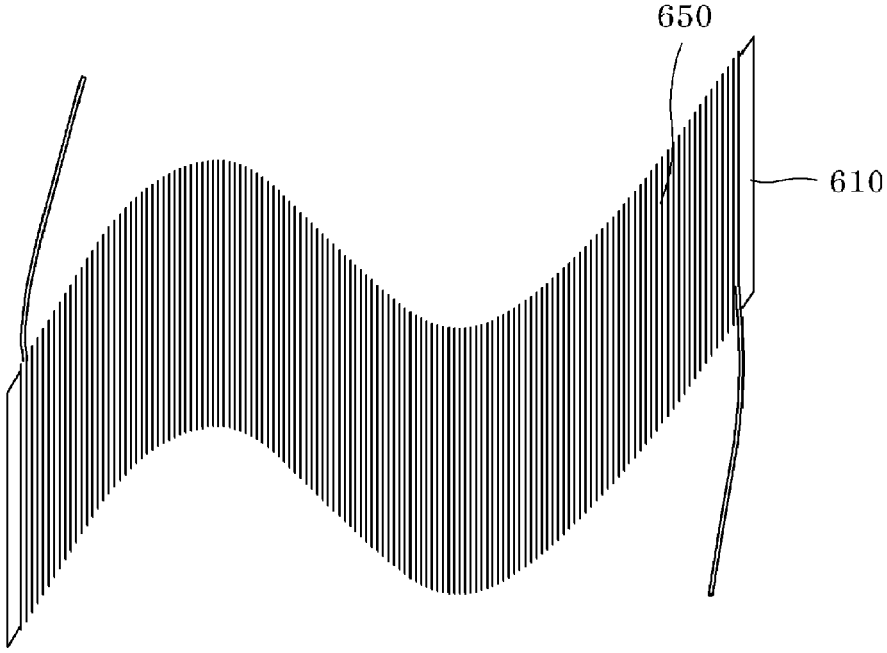
FIG. 13 is a schematic view of a flexible planar substrate based on surface field electron emitters fabricated using a carbon nanotube yarn according to an embodiment of the present invention.

FIG. 13 is a schematic view of a flexible planar substrate based on surface field electron emitters fabricated using a carbon nanotube yarn according to an embodiment of the present invention.

Referring to FIG. 13, a carbon nanotube yarn 650 according to an embodiment of the invention is uniformly wound around a prepared planar flexible substrate 610, which may be applied to field electron emitting devices such as backlight units for flat displays.

The brightness of the backlight unit may be adjusted by a method of winding the carbon nanotube yarn 650 or by controlling a winding separation thereof.

Figure 14:
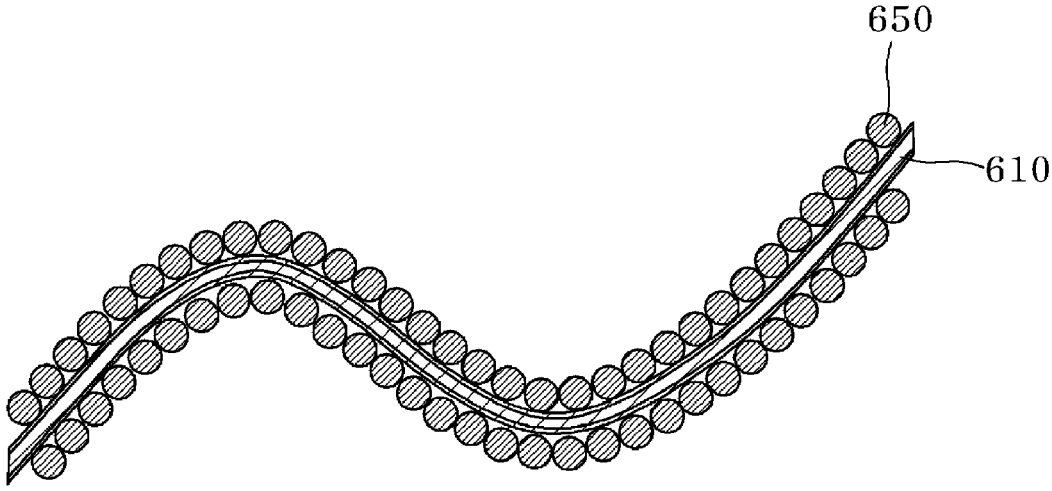
FIGS. 14 and 15 are cross-sectional views of the flexible planar substrate based on the surface field electron emitter fabricated using the carbon nanotube yarn according to the embodiment of the present invention.
Figure 15:
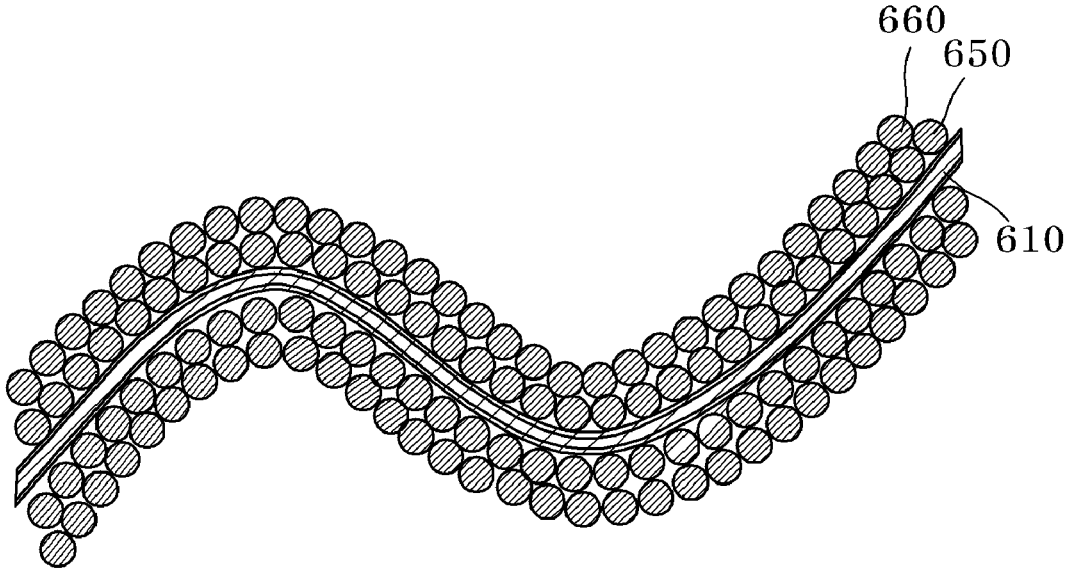

FIGS. 14 and 15 are cross-sectional views of the flexible planar substrate based on the surface field electron emitter fabricated using the carbon nanotube yarn according to the embodiment of the present invention.

FIG. 14 shows a carbon nanotube yarn 650 wound in a single layer around the flexible planar substrate 610, and FIG. 12 shows first and second carbon nanotube yarn layers 650 and 660 wound in double layers around the planar substrate 610. When the carbon nanotube yarn is wound in double layers, the density and bonding force of the field electron emitters with respect to the substrate 610 can be further increased.

Figure 16:
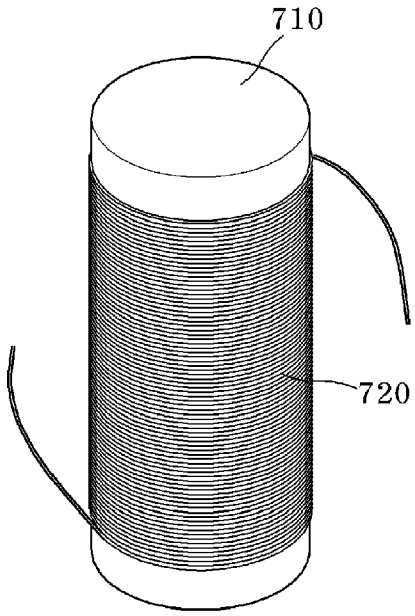
FIG. 16 is a schematic view of a cylindrical substrate based on surface field electron emitters fabricated using a carbon nanotube yarn according to an embodiment of the present invention.

FIG. 16 is a schematic view of a cylindrical substrate based on surface field electron emitters fabricated using a carbon nanotube yarn according to an embodiment of the present invention.

Referring to FIG. 16, a carbon nanotube yarn 720 according to an embodiment of the present invention is uniformly wound around a prepared cylindrical substrate 710, which may be applied to field electron emitting devices.

The brightness of a light source of the field electron emitting device may be adjusted by a method of winding the carbon nanotube yarn 720 or by controlling a winding separation thereof.

Additionally, the surface field electron emitters fabricated using the carbon nanotube yarn of the present invention may be used in a wound state around a polygonal, character or figure board. The polygonal board may include a rectangular board, a rhombus-shaped board, a triangular board, a pentagon-shaped board, an oval board, a star-shaped board, and the like. The board may have a character or figure shape. The board may be conductive or non-conductive.

Figure 17:
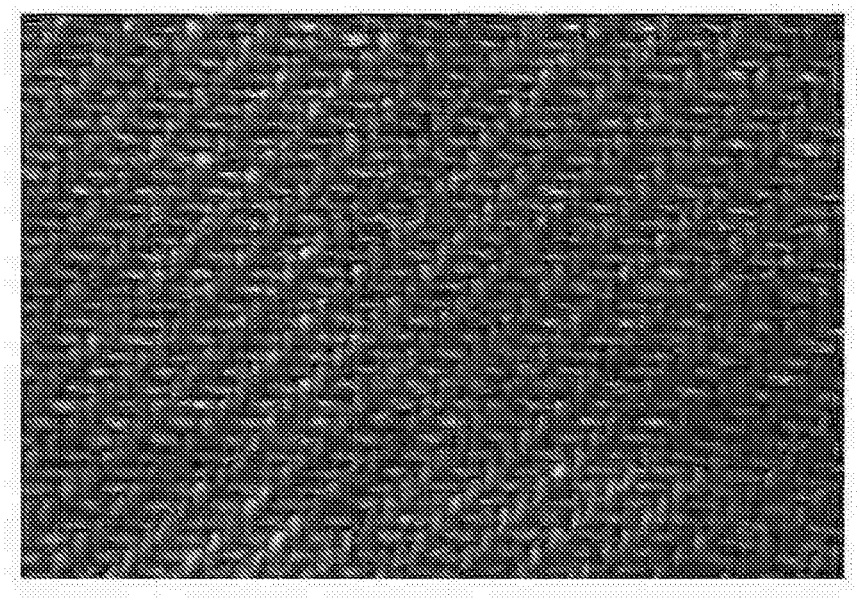
FIG. 17 is a picture of a woven fabric type surface field electron emitter fabricated using a carbon nanotube yarn according to an embodiment of the present invention.

FIG. 17 is a picture of a woven fabric type surface field electron emitter fabricated using a carbon nanotube yarn according to an embodiment of the present invention.

FIG. 17 shows the woven fabrics fabricated using the carbon nanotube yarn according to the embodiment of the invention. Such a woven fabric type surface field electron emitter can be easily applied to the flexible substrate as shown in FIG. 13.

Figure 18:
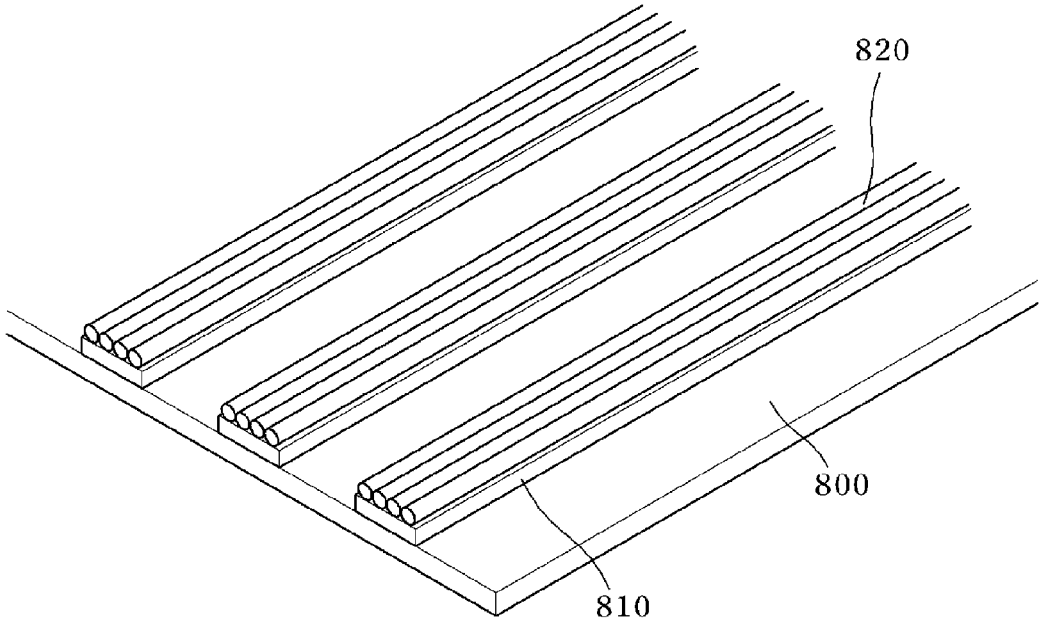
FIG. 18 is a schematic view of a diode or triode type field electron emitting device including carbon nanotube yarns according to an embodiment of the present invention.

FIG. 18 is a schematic view of a diode or triode type field electron emitting device including carbon nanotube yarns according to an embodiment of the present invention.

Referring to FIG. 18, silver pastes are printed on a rear glass substrate 800 of a diode or triode type field emitting device to form silver electrodes 810, followed by aligning carbon nanotube yarns 820 according to an embodiment of the invention on each of the silver electrodes 810. Here, the carbon nanotube yarns 820 may be aligned along the silver electrode 810, but the present invention is not limited thereto.

Screen brightness of the field electron emitting device is determined by energy intensity and density of electrons emitted from the cathode thereof. At this time, since the carbon nanotube yarns 820 according to the embodiment emit electrons uniformly from the overall surfaces thereof, the field electron emitting device provides good image quality and exhibits reduced power consumption while realizing the same degree of brightness as conventional field electron emitting devices.

Figure 19:
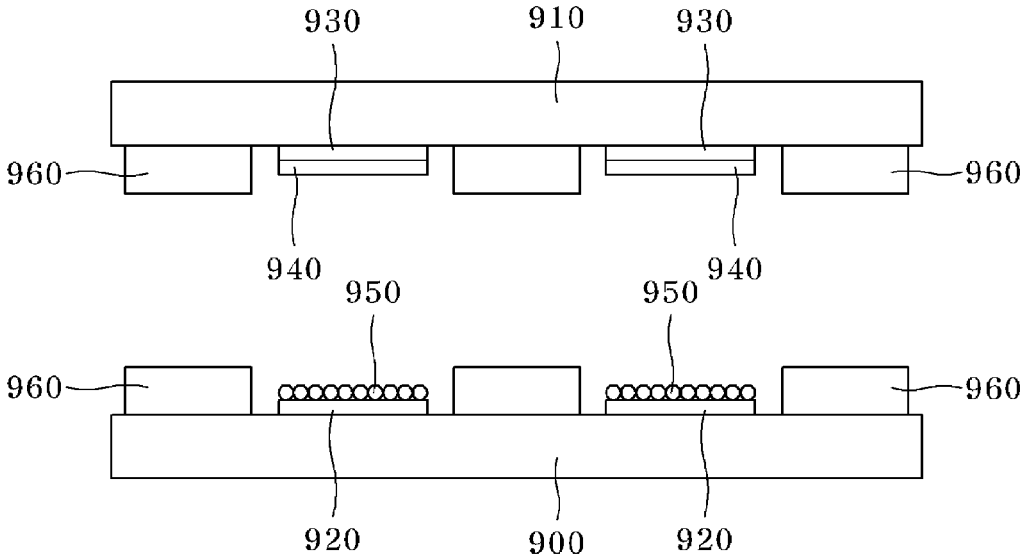
FIG. 19 is a cross-sectional view of a diode type field electron emitting device including carbon nanotube yarns according to an embodiment of the present invention.

FIG. 19 is a cross-sectional view of a diode type field electron emitting device including carbon nanotube yarns according to an embodiment of the present invention.

Referring to FIG. 19, a space between a front glass substrate 910 and a rear glass substrate 900 is divided by insulating spacers 960 to form a predetermined pattern on each of the glass substrates 900 and 910. An anode 930 and a cathode 920 are provided to face each other in each space between the insulating spacers 960.

The anodes 930 are deposited on the front glass substrate 910 by ITO deposition or silver pastes, and have phosphors 940 coated thereon in a predetermined pattern. Corresponding to the anodes 930, the cathodes 920 are also deposited on the rear glass substrate 910 by ITO deposition or silver pastes, and have carbon nanotube yarns 950 according to an embodiment of the present invention arranged thereon.

Then, the front and rear glass substrates 910 and 900 are assembled to each other such that respective corresponding electrodes face each other.

When an electric field is applied to the cathode 920, the phosphors 940 are excited by electrons emitted from the carbon nanotube yarns 950 to emit light. Here, the space divided by the insulating spacers 960 prevents the light from being leaked to the surroundings, and the carbon nanotube yarns 950 improve electron emission from each segment as compared with conventional field electron emitting devices that do not include the carbon nanotube. In other words, the brightness of each segment can be improved.

Figure 20:
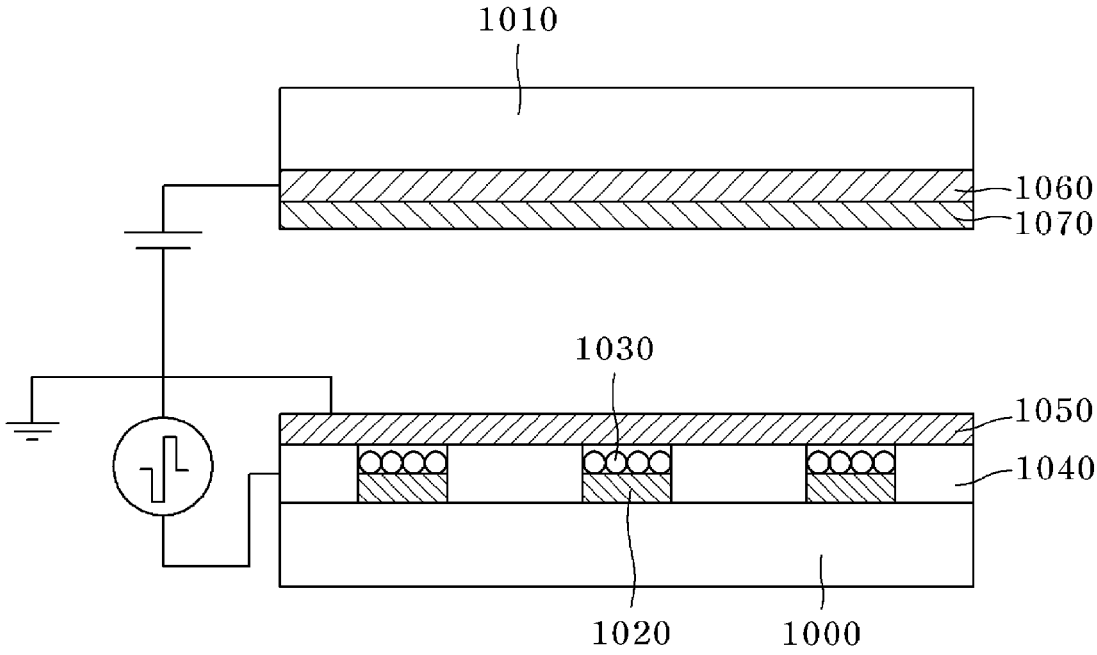
FIG. 20 is a cross-sectional view of a triode type field electron emitting device including carbon nanotube yarns according to an embodiment of the present invention.

FIG. 20 is a cross-sectional view of a triode type field electron emitting device including carbon nanotube yarns according to an embodiment of the present invention.

Referring to FIG. 20, an upper surface of a glass substrate 1000 is divided by insulating spacers 1040 formed thereon to have a predetermined pattern on the surface of the glass substrate 1000, and has a cathode 1020 disposed in each space defined between the insulating spacers 1040. Carbon nanotube yarns 1030 according to an embodiment of the present invention are arranged on an upper surface of each cathode 1020, and a grid 1050 is formed perpendicular to the cathodes 1020 and the carbon nanotube yarns 1030.

Here, the grid 1050 determines whether the field electron emitting device is a diode type or a triode type, and may be formed to cross anodes 1060 and phosphors 1070 formed on a front glass substrate 1010. The anodes 1060 and phosphors 1070 applicable to a cathode ray tube are formed in sequential line patterns of R, G and B.

The triode type field electron emitting device according to the embodiment of the invention is also operated by the same operating principle as that of the diode type field electron emitting device. In the triode type field electron emitting device of this embodiment, the carbon nanotube yarns 1030 improve brightness and color realization compared with the conventional field electron emitting devices that do not include the carbon nanotube.

As described above, the surface field electron emitters based on the carbon nanotube yarn according to the embodiments of the present invention may be applied to planar or curved electronic devices in various fields.

Further, the surface field electron emitters according to the embodiments of the present invention may be used for any application that requires light emission. Examples of the planar electronic devices include electron beam emitting devices for bacteria sterilization, electron beam emitting devices for non-destructive examination, visible light sources for illumination, lamps, backlight units for flat displays, electron sources for X-ray devices, electron sources for high output microwaves, and the like.

Further, examples of the curved electronic devices include small light emitting devices for positioning, signboards, traffic boards, signal lamps, and the like. Moreover, the curved electronic devices may be applied to passive or active matrix-driven flexible field light emission displays.

As apparent from the above description, according to the embodiments of the present invention, in fabrication of carbon nanotube yarn-based surface field electron emitters, a carbon nanotube yarn can be formed to have a uniform surface without using impurities such as conductive organic materials and pastes, thereby improving stability and reliability during field electron emission, and permitting easy fabrication of the surface field electron emitters.

According to the embodiments of the present invention, since the carbon nanotube yarn allows electrons to be uniformly emitted from the surface thereof and can be wound around a variety of frames (planar and flexible material), the carbon nanotube yarn can be applied to cylindrical light sources and various planar or curved electronic devices, such as diode or triode type field electron emitting devices.

Although the present invention has been described with reference to the embodiments and the accompanying drawings, this invention is not limited to the embodiments. Further, it will be apparent to those skilled in the art that various modifications, changes, and substitutions can be made without departing from the spirit and scope of the present invention. Accordingly, it should be understood that the embodiments set forth herein are given by way of illustration only and do not limit the scope of the present invention.

What is claimed is:

1. A surface field electron emitter using a carbon nanotube yarn, comprising:

a plurality of carbon nanotube strands aligned in the same direction and plied with each other, the plied carbon nanotube strands constituting a carbon nanotube yarn having a smooth surface from which tip ends of the carbon nanotube strands are not protruded.

2. The surface field electron emitter according to claim 1, wherein the carbon nanotube strands comprise at least one selected from a multi-walled carbon nanotube (MWCNT), a single-walled carbon nanotube (SWCNT) and a double-walled carbon nanotube (DWCNT).

3. The surface field electron emitter according to claim 1, wherein the carbon nanotube strands are plied with each other in a state of being aligned parallel to each other in the same direction, or plied with each other in a twisted shape.

4. The surface field electron emitter according to claim 1, wherein the carbon nanotube yarn has a thickness of 1-1000 μm.

5. A method of fabricating a carbon nanotube yarn for use in a field electron emitting device, comprising:

preparing a plurality of carbon nanotube strands;

forming a carbon nanotube yarn by passing the carbon nanotube strands through a plying unit with the carbon nanotube strands aligned in the same direction, the forming a carbon nanotube yarn comprising surface treatment for densification by immersing the carbon nanotube strands in an organic solvent when the carbon nanotube strands enter the plying unit filled with the organic solvent, and applying tension to the carbon nanotube yarn discharged from the plying unit to provide a smooth surface to the carbon nanotube yarn while increasing a bonding force between the carbon nanotube strands and preventing tip ends of the carbon nanotube strands from protruding from the surface of the carbon nanotube yarn; and heat treating the carbon nanotube yarn.

6. The method according to claim 5, wherein the plying unit is rotatable, and the plurality of carbon nanotube strands are plied with each other in a state of being aligned parallel to each other in the same direction or plied with each other in a twisted shape by controlling a rotational speed of the plying unit.

7. The method according to claim 6, wherein the rotational speed of the plying unit is controlled in the range of 10-300 rpm.

8. The method according to claim 5, wherein the carbon nanotube strands pass through the plying unit within 2 seconds to 9 minutes.

9. The method according to claim 5, wherein the organic solvent is at least one selected from methanol, ethanol, acetone, dichloroethane, chloroform, ethylene glycol, dichlorobenzene, and dimethylformamide.

10. The method according to claim 5, wherein the tension applied to the carbon nanotube yarn is controlled in the range of 0.0005-0.5 mN.

11. The method according to claim 5, wherein the heat treating is performed for 1-30 minutes at 100-1,500° C.

12. The method according to claim 5, further comprising:

irradiating an electron beam or a laser beam onto the surface of the carbon nanotube yarn to provide a smoothly finished surface to the carbon nanotube yarn after the heat treating.

13. The method according to claim 5, wherein the carbon nanotube yarn has a plied density of $10^2$-$10^5$ carbon nanotube strands per unit cross-sectional area ($km^2$) with respect to a thickness of the carbon nanotube yarn.

14. A carbon nanotube yarn comprising a plurality of carbon nanotube strands plied with each other in a state of being aligned in the same direction by applying a tension of 0.0005-0.5 mN to the carbon nanotube strands to have a plied density of $10^2$-$10^5$ carbon nanotube strands per unit cross-sectional area ($\mu m^2$) with respect to a thickness of the carbon nanotube yarn, the plied carbon nanotube strands constituting a smooth surface of the carbon nanotube yarn from which tip ends of the carbon nanotube strands are not protruded.

15. A carbon nanotube yarn-based surface field electron emitting device, comprising:

a substrate; and the carbon nanotube yarn on the substrate or wound around an overall surface of the substrate, wherein the carbon nanotube yarn comprises a plurality of carbon nanotube strands plied with each other in a state of being aligned in the same direction, and the plied carbon nanotube strands constitute a smooth surface of the carbon nanotube yarn from which tip ends of the carbon nanotube strands are not protruded.

16. The surface field electron emitting device according to claim 15, wherein the substrate is formed of one selected from metal, glass, paper and a flexible plastic material.

17. The surface field electron emitting device according to claim 15, wherein the substrate has a planar shape of a polygon or looped curve and is formed to allow the carbon nanotube yarn to be wound at uniform intervals around the surface thereof.

18. The surface field electron emitting device according to claim 15, wherein the substrate has a three-dimensional shape and is formed to allow the carbon nanotube yarn to be wound at uniform intervals around the surface thereof.

19. The surface field electron emitting device according to claim 17, wherein the carbon nanotube yarn is wound around the substrate in two or more layers.

20. The surface field electron emitting device according to claim 15, wherein the carbon nanotube yarn is formed into woven fabrics to be wound around the substrate or arranged on the substrate.

21. A carbon nanotube yarn-based surface field electron emitting device, comprising:

a cylindrical tube-shaped substrate; and the carbon nanotube yarn through the substrate, wherein the carbon nanotube yarn comprises a plurality of carbon nanotube strands plied with each other in a state of being aligned in the same direction, and the plied carbon nanotube strands constitute a smooth surface of the carbon nanotube yarn from which tip ends of the carbon nanotube strands are not protruded.

22. A diode type surface field electron emitting device comprising:

front and rear glass substrates assembled to each other with a separation space defined therebetween;

insulating spacers arranged in the separation space to form a line type light emitting region in the separation space;

a cathode provided to a region between the insulating spacers on the rear glass substrate;

the carbon nanotube yarn disposed on the cathode;

an anode provided to a region between the insulating spacers on the front glass substrate; and a phosphor layer formed on the anode, wherein the carbon nanotube yarn comprises a plurality of carbon nanotube strands plied with each other in a state of being aligned in the same direction, and the plied carbon nanotube strands constitute a smooth surface of the carbon nanotube yarn from which tip ends of the carbon nanotube strands are not protruded.

23. A triode type surface field electron emitting device comprising:

a rear glass substrate comprising line type insulating spacers;

a cathode provided to a region between the insulating spacers on the rear glass substrate;

the carbon nanotube yarn disposed on the cathode;

a grid formed above the spacers to be spaced from the carbon nanotube yarn and formed in a line pattern orthogonal to the line type insulating spacers;

an anode bonded onto the grid to cross the grid; and a front glass substrate including a phosphor formed on the anode, wherein the carbon nanotube yarn comprises a plurality of carbon nanotube strands plied with each other in a state of being aligned in the same direction, and the plied carbon nanotube strands constitute a smooth surface of the carbon nanotube yarn from which tip ends of the carbon nanotube strands are not protruded.

* * * * *